US007882951B2

(12) United States Patent
Zelina et al.

(10) Patent No.: US 7,882,951 B2
(45) Date of Patent: Feb. 8, 2011

(54) PRECONFIGURED GIFT WRAP AND PACKAGING ASSEMBLY

(75) Inventors: Karen Marie Zelina, Sagamore Hills, OH (US); Joel Thomas Hageman, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 192 days.

(21) Appl. No.: 12/277,620

(22) Filed: Nov. 25, 2008

(65) Prior Publication Data

US 2010/0127055 A1 May 27, 2010

(51) Int. Cl.

| | |
|---|---|
| ***B65D 73/00*** | (2006.01) |
| ***B65D 71/00*** | (2006.01) |
| ***B65D 33/14*** | (2006.01) |
| ***B65D 30/20*** | (2006.01) |

(52) U.S. Cl. ..... 206/495; 206/457; 206/575; 383/13; 383/22; 383/120

(58) Field of Classification Search ..... 206/495, 206/223, 575, 577, 554, 457, 461, 806; 229/102.5, 229/116.1, 116.5, 923; 383/120, 125, 13, 383/22, 24, 98, 99

See application file for complete search history.

(56) References Cited

U.S. PATENT DOCUMENTS

| | | | | | |
|---|---|---|---|---|---|
| 875,224 | A | * | 12/1907 | Underwood | 383/21 |
| 2,272,938 | A | * | 2/1942 | Ferrante | 383/95 |
| 3,132,742 | A | * | 5/1964 | Shapiro et al. | 383/13 |
| 3,679,120 | A | | 7/1972 | Rubin | |
| 4,329,382 | A | | 5/1982 | Truskolaski et al. | |
| 4,402,452 | A | * | 9/1983 | Kupersmit | 229/117.01 |
| 4,571,232 | A | | 2/1986 | Diehl | |
| 4,585,676 | A | | 4/1986 | DeSmet et al. | |
| 4,608,283 | A | | 8/1986 | White | |
| 4,836,690 | A | * | 6/1989 | Cheng | 383/6 |
| 4,858,822 | A | * | 8/1989 | Johnson et al. | 229/137 |
| 5,007,229 | A | | 4/1991 | Weder et al. | |
| 5,044,773 | A | * | 9/1991 | Harms et al. | 383/22 |
| 5,048,676 | A | * | 9/1991 | Borgis et al. | 206/419 |
| 5,065,935 | A | * | 11/1991 | Mancel | 229/136 |
| 5,114,761 | A | | 5/1992 | Doherty | |
| 5,245,815 | A | | 9/1993 | Savage | |
| 5,306,372 | A | | 4/1994 | Hall et al. | |
| 5,364,015 | A | | 11/1994 | Hirschey | |
| 5,490,597 | A | | 2/1996 | Schluger | |
| 5,584,429 | A | | 12/1996 | Savage | |
| 5,645,902 | A | | 7/1997 | Cheng | |
| 5,740,959 | A | | 4/1998 | Savage | |

(Continued)

*Primary Examiner*—J. Gregory Pickett
(74) *Attorney, Agent, or Firm*—Roetzel & Andress; James C. Scott

(57) ABSTRACT

A gift wrap package and packaging assembly is configured to receive and enclose a gift in a decorative enclosure and which has the appearance of a conventionally wrapped box gift package. The gift package is made of a folded sheet material that is decorated on one side, and which has sufficient material strength to serve as both a box and a decorative package which has a comparable appearance to a box wrapped with decorative paper. The gift package is preformed and packaged in a folded box configuration with a protective retail display header for hanging display. One end of the gift package is configured to be opened to receive gift contents and additional packaging such as tissue, and then securely closed to complete the gift package.

7 Claims, 6 Drawing Sheets

U.S. PATENT DOCUMENTS

| | | | |
|---|---|---|---|
| 5,826,402 | A | 10/1998 | Savage |
| 5,836,508 | A | 11/1998 | Savage |
| 6,187,403 | B1 | 2/2001 | Richardson |
| 6,343,734 | B1 | 2/2002 | Smith |
| 6,647,697 | B1 | 11/2003 | Zarrow et al. |
| 2005/0072817 | A1 | 4/2005 | Cheng |
| 2006/0060642 | A1 | 3/2006 | Rosier |
| 2006/0185991 | A1 | 8/2006 | Abercia et al. |
| 2007/0138248 | A1 | 6/2007 | Wallen et al. |
| 2008/0152265 | A1 | 6/2008 | Feeney |

* cited by examiner

PRECONFIGURED GIFT WRAP AND PACKAGING ASSEMBLY

RELATED APPLICATIONS

There are no applications related to this application.

FIELD OF THE INVENTION

The present disclosure pertains generally to containers and packaging and wrapping, and more particularly, to gift packaging and wrapping in the form of folded paper, paperboard or other foldable sheet material.

BACKGROUND OF THE INVENTION

Gift wrap is an important aspect of gift giving. It provides the function of concealing the gift, creating an attractive and occasion-appropriate theme or message, and provides a fun activity for the recipient to unwrap the gift. Conventional gift wrapping is done with decorative paper of relatively thin gauge, folded or formed around a gift container such as a box, with flaps at the box ends formed by symmetrical folds. Although this provides an attractive gift which is appropriate for many different types of occasions, it can be tedious and time-consuming, and is beyond the skill level of many people to perform satisfactorily. Consumers are looking for easy and quick ways to attractively wrap gifts, but want the look and wrapping experience of a traditionally wrapped gift which takes time and skill to create.

SUMMARY OF THE INVENTION

A gift package of the disclosure in one embodiment is made of decorative sheet form material which is configured to have a front panel, a back panel, a bottom panel, and two side panels, each of the panels being respectively interconnected to form a three-dimensional rectangular package with at least one opening designed to permit the insertion of one or more gift objects, and a closure to seal the gift package and complete the appearance of a wrapped gift. In an exemplary embodiment, the gift package of the disclosure is made from a paper-like decorative material having a weight of about 120 to about 250 grams per square meter. When constructed of material in this weight or density range, the gift package has the general look and feel of gift wrap and sufficient strength to serve as a container structure in place of a conventional cardboard box which is conventionally wrapped with relatively very thin gauge paper. The gift package thus provides a structural and aesthetic combination of a gift container combined with an aesthetic finish which has the appearance of gift wrapping paper. In another aspect of the disclosure, the gift package is packaged for sale by combination with a protective retail display header that is substantially rectangular and made of paperboard over the open end of said gift package.

In accordance with another aspect of the disclosure and related inventions, there is provided in combination, a gift package for receiving and securely retaining gift contents in combination with a protective retail display header which is folded about the gift package with the gift package in a folded configuration, the gift package and protective retail display header combination including: a gift package of a generally cubic structure formed by interconnected panels including: a front panel; a back panel generally opposed to the front panel; first and second generally opposed side panels; a bottom panel; the front panel comprising one main panel that is connected to the bottom panel along a horizontal fold line and connected to the first and second generally opposed side panels along two parallel vertical fold lines; the back panel comprising a main panel connected along a horizontal fold line to a sub-panel that is connected to the bottom panel along a horizontal fold line; the first side panel comprising five first side sub panels, two of which are connected along a horizontal fold line to the bottom panel, two of which are connected to the back panel along a vertical fold line, and one which is connected to the front panel along a vertical fold line, and a vertical crease bisecting the first side panel; the second side panel comprising five second side sub panels, two of which are connected along a horizontal fold line to the bottom panel, two of which are connected to an end tab along a vertical fold line, and one of which is connected to the front panel along a vertical fold line, and a vertical crease bisecting the second side panel; the bottom panel comprising a bottom left side flap comprising two panels bisected by a vertical fold line and connected to the first side panel along a horizontal fold line, a bottom right side flap comprising two panels bisected by a vertical fold line and connected to the second side panel along a horizontal fold line, a bottom back flap comprising three panels that are connected to the back panel along a horizontal fold line, and a bottom front flap comprising three panels that are connected to the front panel along a horizontal fold line; a front flap connected to the front panel along a horizontal fold line, a back flap that is connected to the back flap along a horizontal fold line, and a left side flap connected to the second side panel along a horizontal fold line and comprising a downward folding lip across its top edge; wherein the opening to the gift package is closed by the front flap folded relative to the front panel, the back flap folded relative to the back panel, and the left side flap, comprising a downward folding lip across its top edge, folded relative to the second side panel wherein the downward folding lip is inserted into the inside of the first side panel; a retail display header comprising a substantially rectangular piece of paperboard; wherein the paperboard contains a fold line that bisects the center of the protective retail display header; wherein the paperboard contains two straps, one strap attached to each panel attached to the inside portion of paperboard each located proximate to the center fold line and configured to engage with the gift package; wherein at least one of the strap has adhesive applied to a surface thereof; wherein the paperboard contains two openings spaced approximately ½ inch from the fold line and which can be aligned to form an opening when the paperboard is folded along the center fold line to receive a display hanger for hanging display of the gift package and retail display header combination; wherein the two straps are adhered to one another and not in contact with the gift package secured by the header; and wherein the gift package is inserted underneath each strap and folded with the header at the bisecting fold line.

These and other aspects of the disclosure and related inventions are further described herein in detail with reference to the accompanying drawings.

DETAILED DESCRIPTION OF PREFERRED AND ALTERNATE EMBODIMENTS

Figure 1:
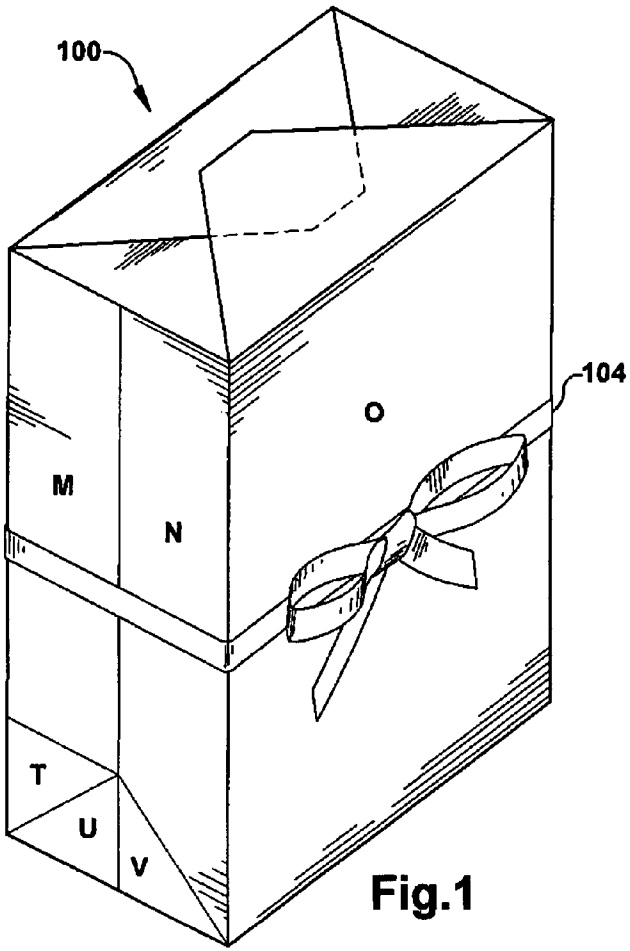
FIG. 1 illustrates the filly assembled package.

The present disclosure pertains generally to containers and packaging and decorative wrap or covering, and more particularly to gift wrapping or packaging in the form of folded paper, paperboard or other foldable sheet material which serves as both a structural container for one or more objects, and which has a decorative outer layer or adornment to also provide an aesthetic package for example as a gift package. As illustrated in FIG. 1, a representative gift package or gift wrap 100 of the disclosure has in one particular form a generally rectangular and cubic shape, and when erect and in an unfolded condition, the general appearance and configuration of a gift wrapped box. The terms "gift package" and "gift wrap" are used synonymously herein to refer to both the material and structure which is used to conceal, contain or wrap an object such as a gift, and the completed package of an object or objects or gift(s) contained within a gift wrap structure of the type disclosed herein.

A preferred embodiment of the gift package 100 is made of printed paper weighing between 120-250 gsm with a die-cut form which is scored to form fold lines, pleats and closure flaps, which together form interconnected panels which form a generally rectangular container and closure to receive and enclose an object such as a gift. The exterior surface of the material from which the gift package 100 is constructed may be printed and finished or coated in a variety of decorative designs resembling traditional gift wrap paper. Printing may be applied directly to the exterior surface of the gift package material, or applied as a separate relatively thin layer of any suitable material which is pre-applied or laminated to the underlying gift package material. The gift package 100 may also utilize any suitable type of adhesive to seal the closure flaps of the gift package closed, as further described. Representative dimensions of the gift package include, but are not limited to: Small (6" Wide×7⅞" High/Long×3½" Deep); Medium (7 3/32" Wide×10 1/32" High/Long×3 15/16" Deep); and Large (10" Wide×15¼" High/Long×3½" Deep). With closure flaps as disclosed, the gift package 100 is loaded, sealed and opened at one of the ends of the package. A closure end is opened so the consumer can slide in their gift, optionally with some tissue paper to hold/buffer the gift inside. The contents of the gift package, including any internal packaging such as tissue paper, bubble wrap or other contents also serves to fill out the package to a filly erect configuration which most resembles a wrapped rigid box. The consumer then folds the top flaps to close and seal the gift inside. The gift package 100 may further include seals, built in tabs and clasps, scored folds, and/or any other method of closing flaps at the top of the gift package, as further described.

FIG. 1 depicts a preferred embodiment of the disclosure as a filly assembled and erected or filled gift package, generally indicated at 100, shown in combination with a decorative bow 104 affixed around the midsection of the package. The bow is but one variation of a decorative embellishment, which may also include, ribbon, tags, attachments or any other decorative adornment. As depicted, the gift package 100 has the general appearance of a wrapped box, i.e. gift wrap paper applied over a conventional box, without the internal structure of a conventional box, as a result of the gauge stiffness of the gift package material.

Figure 2:
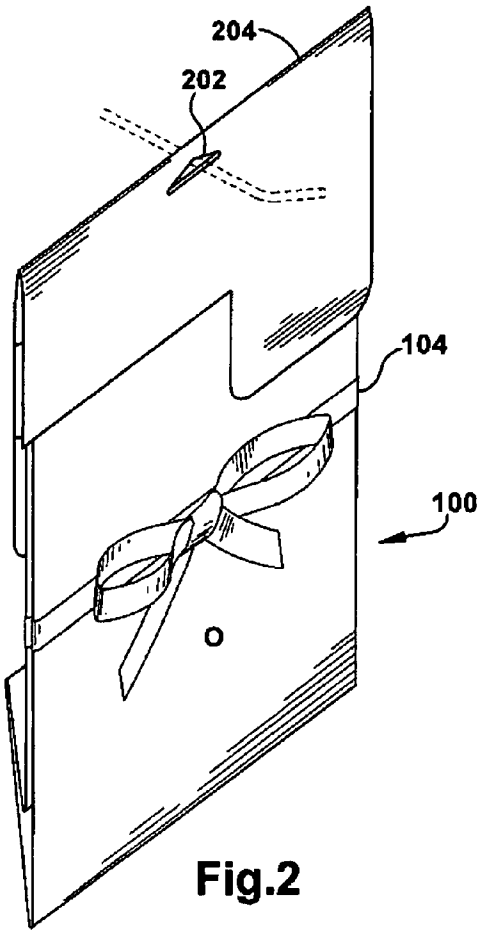
FIG. 2 illustrates the package when packaged for sale (front view)

FIG. 2 shows the gift package 100 in a folded and packaged configuration in combination with a retail display header 204 prepared for display and sale with a protective retail display header (hereinafter referred to as "header") 204 secured over the top or one end of the collapsed gift package 100. The header 204 can be formed with an opening at top center 202 to facilitate easy hang tag display.

Figure 3:
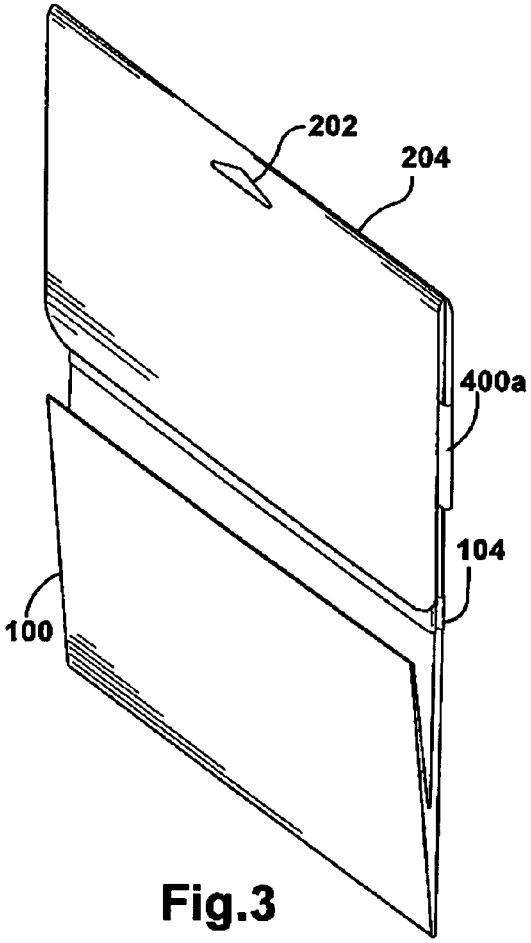
FIG. 3 illustrates the package when packaged for sale (back view)
Figure 4:
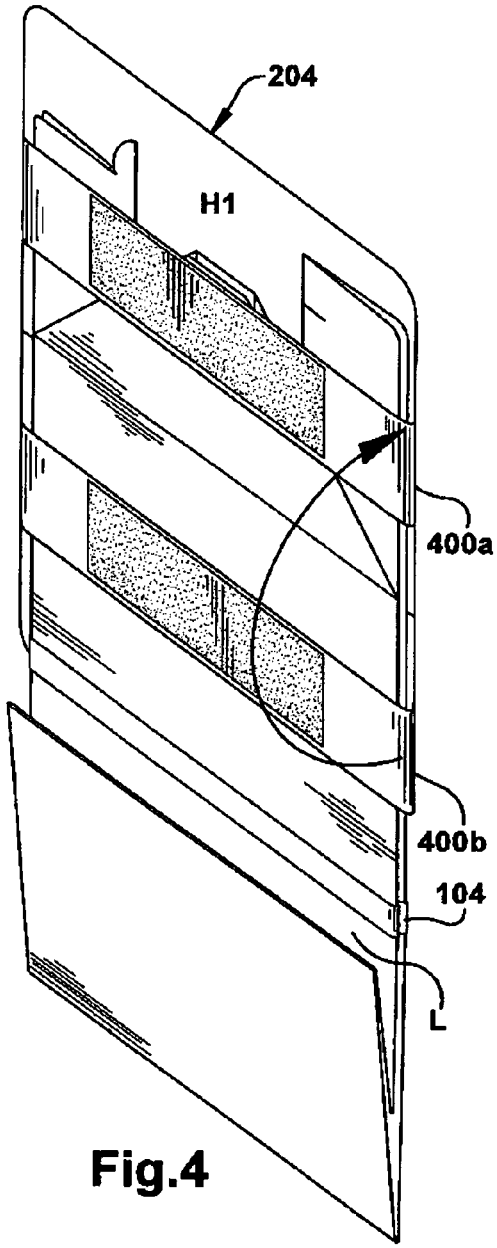
FIGS. 4 & 5 illustrate the process of attaching the packaging to the collapsed package.
Figure 5:
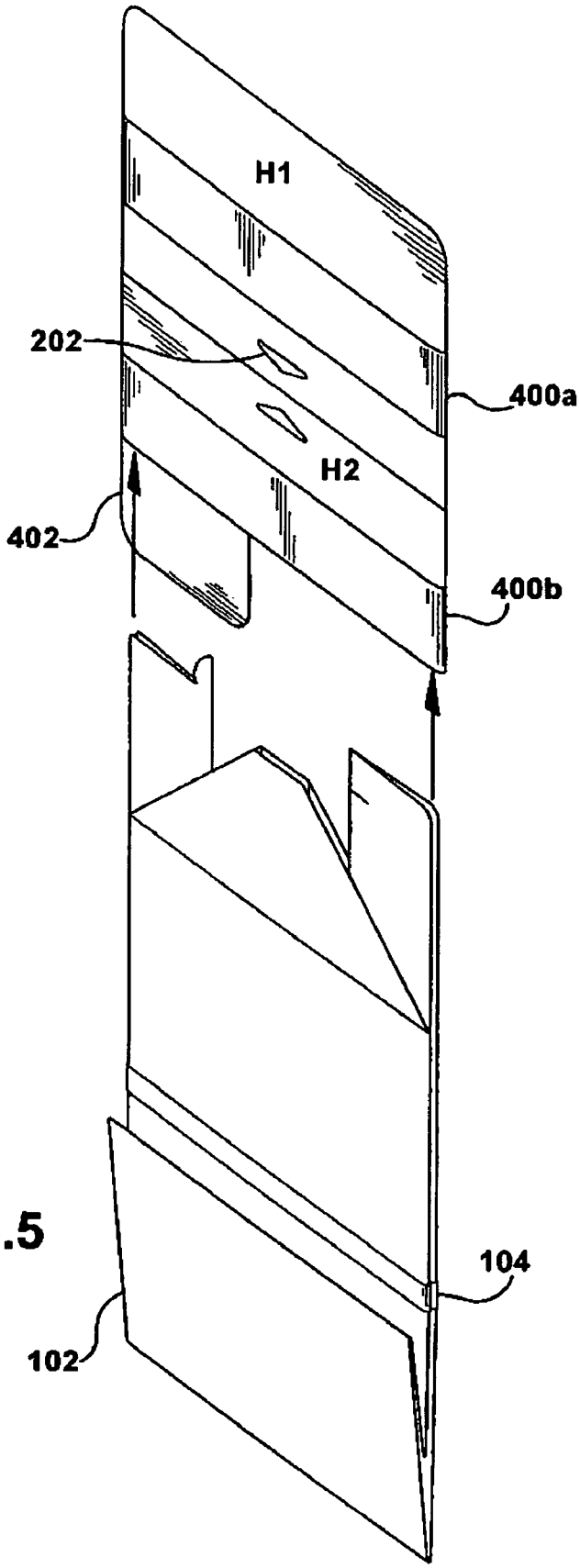

FIGS. 3-5 illustrate how the header 204 is placed over the collapsed gift package 100, in the collapsed or folded configuration as shown, so as to allow for hanging display and for clean and easy removal of the header 204. As indicated in FIG. 5, the header 204 is a generally rectangular piece of paperboard with a bisecting horizontal fold line which creates two panels H1 and H2 and that has an overhang 402 on the left side of the header 204. Two straps 400*a* and 400*b* are located over each panel H1, H2 to enable the header 204 to slide onto the top of the collapsed gift package 100. The paperboard contains any type of suitable adhesive such as hot melt adhesive, double-sided tape, or pressure sensitive adhesive (PSA) on the facing surfaces areas of the strap pieces 400*a*, 400*b*. The gift package 100 is inserted underneath each strap 400*a*, 400*b* and folded with the header 204 at the bisection fold line, as shown in FIG. 4. The two openings 202 are lined up with each other and the two straps 400*a*, 400*b* are placed on top of each other. The straps 400*a*, 400*b* are strategically placed so that they will attach to each other at the adhesive areas as indicated to hold the gift package in place while also keeping the surface of the gift package 100 free from any adhesive or other attachment devices.

Figure 7:
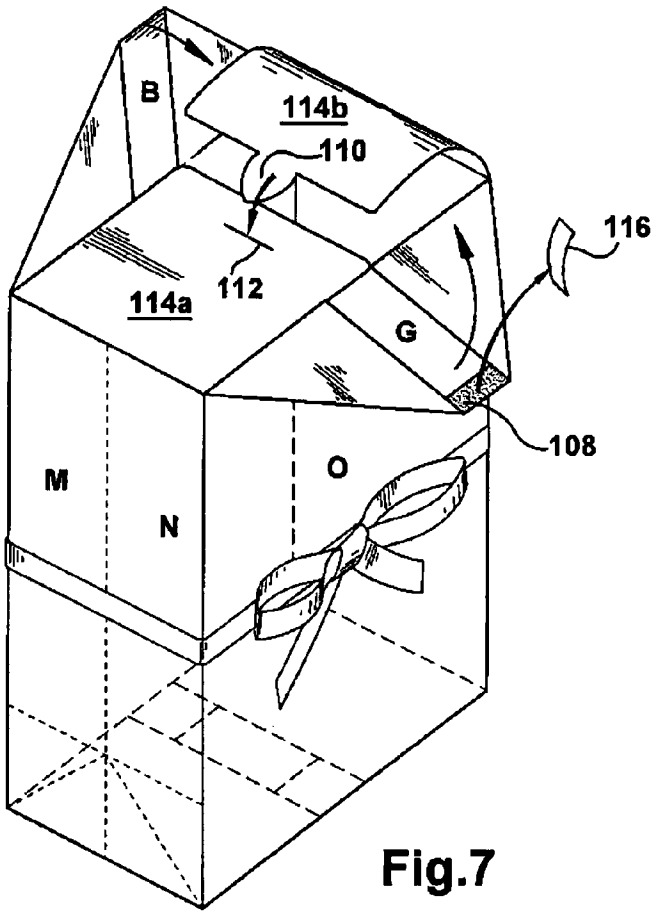
FIG. 7 illustrates the process of closing the using interlocking tabs and pressure sealed adhesive strip.
Figure 6:
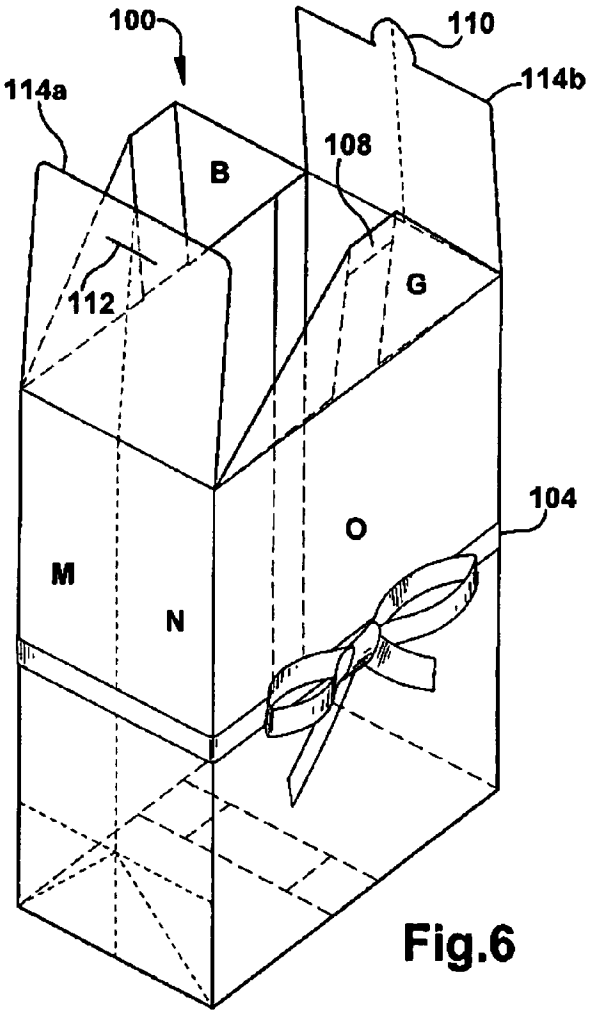
FIG. 6 illustrates the assembled open-topped package.

FIGS. 6 and 7 illustrate the gift package closing process. As FIG. 6 illustrates, the closing mechanism includes two front and back flaps G and B and two side flaps 114*a* and 114*b*, one having a slot 112 and the other a tab 111 at the top center of each flap. A small strip of pressure sensitive or other type of adhesive 108 is attached to the top of front flap G. As FIG. 7 demonstrates, to close the gift package, the tab 110 of flap 114*b* gets inserted into the slot 112 of flap 114*a*. An adhesive cover paper 116 is removed from the adhesive strip 108 at the top of flap G. Back flap B gets folded downward and front flap G gets folded downward on to of back flap B and pressure is applied to the adhesive area of front flap G in order to secure the closure of the gift package 100.

Figure 9:
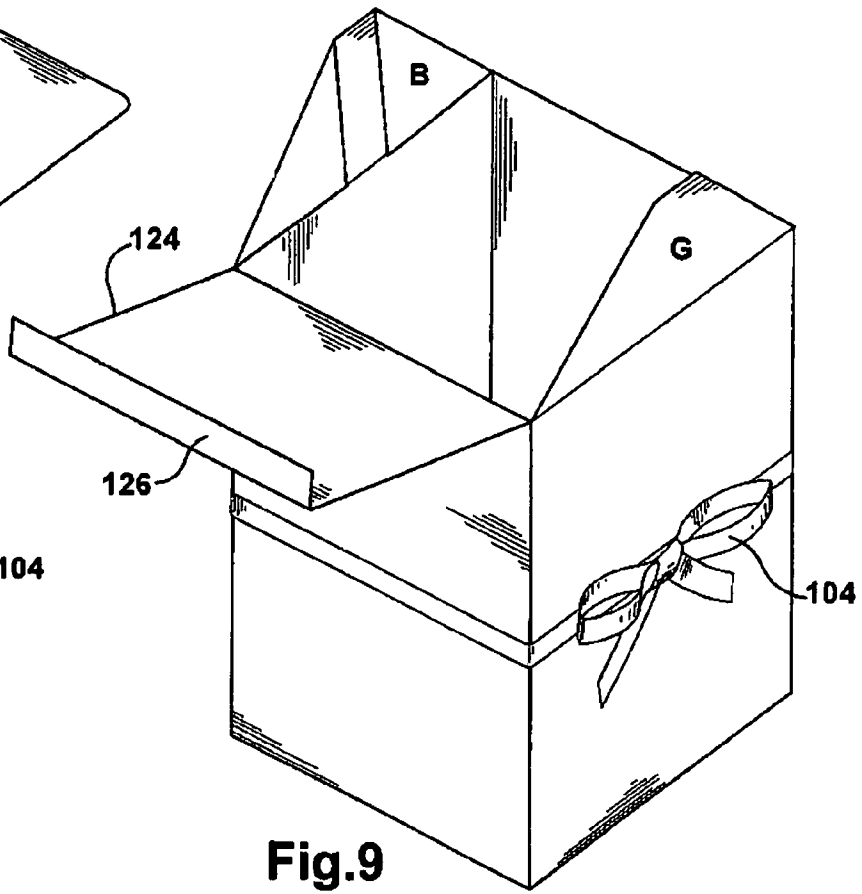
FIGS. 8 & 9 illustrate two alternate embodiments containing unique closing mechanisms.
Figure 8:
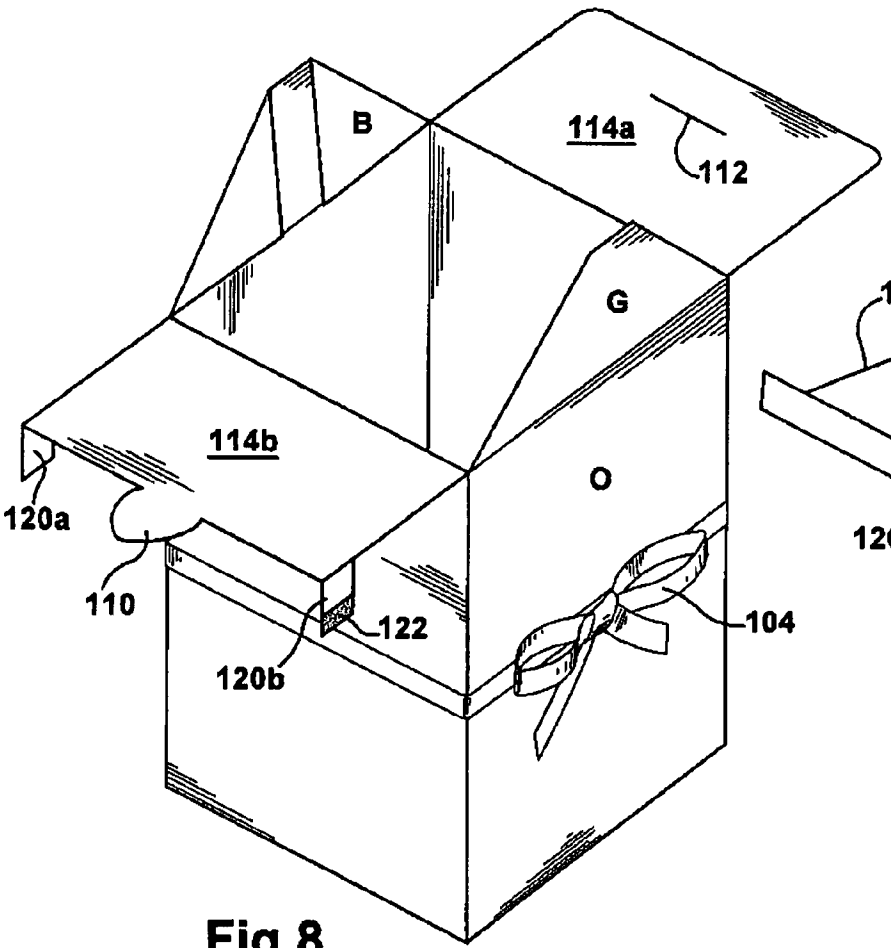

FIGS. 8 and 9 illustrate alternate embodiments of the gift package with alternate closing mechanisms. FIG. 8 shows an embodiment of a closing mechanism that includes front and back flaps G and B and side flaps 114*a* and 114*b* that include tab 110 and slot 112. Flap 114*b* also contains two small wings 120*a* 120*b* attached to the top of each side of the flap. There is a small piece or area of adhesive 122 attached to the top of each wing 120*a* 120*b*. To close this embodiment, the front and back flaps G, B are folded downwards. The two side flaps 114*a* 114*b* are then folded downward with the tab 110 being inserted into the slot 112. To further secure the closure, the two wings 120*a* 120*b* are folded downward and are attached by adhesive to the bottom sides of flap 114*a* or to the front and back panel O, L of the gift package 100. FIG. 9 shows an embodiment that includes a more traditional one-piece box closure mechanism. The gift package includes front and back flaps G, B and one flap 124 on the top left side of the box that includes a folded lip 126 along its top edge. To close this gift package, the front and back flaps G, B get folded downward and the left side flap 124 gets folded downward with the lip 126 tucked inside the right side panel of the gift package.

Figure 10:
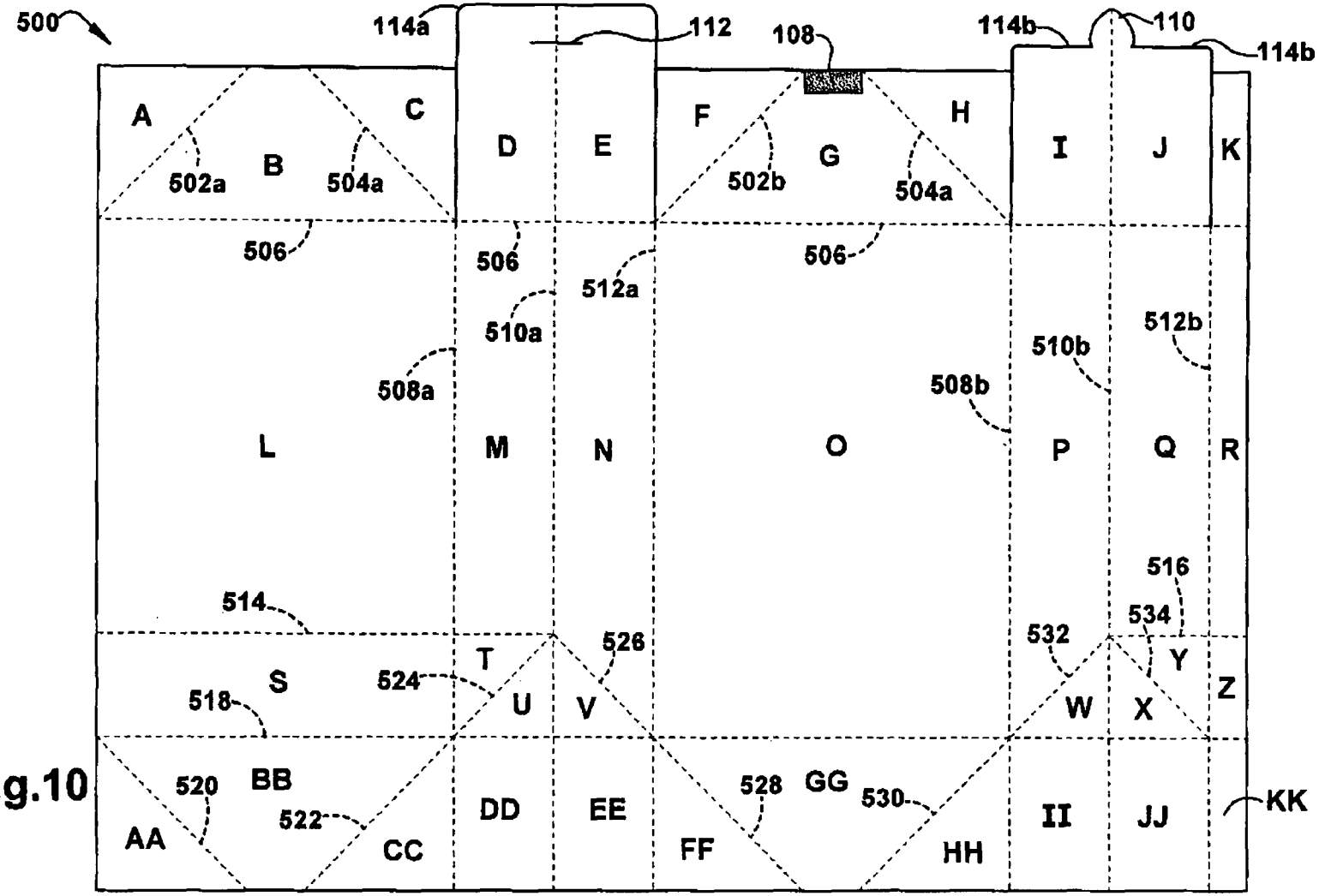
FIG. 10 illustrates the die cut of the preferred embodiment with crease lines.

FIG. 10 shows the die cut pattern of the preferred embodiment of the disclosure, which is a generally rectangular piece of paperboard 500 with two flaps 114*a* 114*b*, flap 114*b* formed with a tab 110 and flap 114*a* formed with a receiving slot 112 interlocking mechanism for closure. The paperboard die cut is creased in several places to facilitate its being folded into the form of and closed as a gift package. The die cut pattern is assembled to form a package containing front and back panels, top and bottom front flaps, top and bottom back flaps, right and left side panels, top and bottom left side panels, top and bottom right side panels, and an end tab.

The back panel of the gift package is formed by a main panel L and a sub-panel S (the designations "front" and "back" being for reference only and are interchangeable). The back panel is attached at one side to a left side panel along a vertical crease 508*a*; to the top back flap along an upper horizontal crease 506; and to the bottom back flap along a lower horizontal crease 518. The back panel can be folded along crease 514 (when collapsed); folded along lower horizontal crease 518 (to create closed bottom flap); and folded along horizontal crease 506 (when the top is closed) and also along crease 508*a*.

The top back flap is formed by panels A, B, and C. It is attached to the back panel along horizontal crease 506 and can be folded along crease lines 502*a*, 504*a*, and 506.

A bottom panel of the gift package is formed by a bottom back flap. The bottom back flap is formed by panels AA, BB, and CC. It is attached to the front panel along lower horizontal crease 518; and to the bottom left flap along vertical crease 508*a*. It can be folded along crease lines 508*a*, 518, 520, and 522 (to create a closed bottom panel).

The left side panel, or left side of the gift package, includes interconnected panels or subpanels M, N, T, U, and V. It is attached to the front panel along crease 512*a*; to the back panel along crease 508*a*; and to the bottom left side along lower horizontal crease 518; and to the top left side flap along horizontal crease 506. It folds along crease fines 510*a*, 514, 524, and 526 (when package is collapsed); along crease line 506 (when package is closed); and along crease line 518 (to create closed bottom panel).

The top left side flap includes panels D and E. It includes a slot at the top of the flap that is bisected by a central vertical crease 510*a*. It is attached to the left side panel along 506 and folds at horizontal crease 506 (when package is closed).

The bottom left side flap includes panels DD and EE. It is attached to the bottom back flap along crease 508*a*; to bottom front flap along a lateral vertical crease 512*a*; and to left side panel along lower horizontal crease 518. It folds along lower horizontal crease 518 (to create closed bottom panel) and is bisected by central vertical crease 510*a*.

Panel O forms a front side or panel of the gift package. Panel O is attached to the left side panel along crease 512*a*; to the right side panel along crease 508*b*; to the top front flap along crease 506; and to the bottom front flap along crease 518. It folds along crease line 518 (to create closed bottom panel); along crease line 506 (when package closed); and along creases 512*a* and 508*b*.

The top front flap includes panels F, G, and H. It is attached to the front panel along crease 506. It folds along crease line 502*b* and 504*a*; and along crease 506 (when package closed). Panel G contains a small strip of adhesive 108 along its top edge.

A bottom panel of the gift package is formed by a bottom front flap. The bottom front flap includes panels FF, GG, and HH. It is attached to the front panel along crease 518; to the left bottom flap along crease 512*a*; and to the right bottom flap along crease 508*b*. It folds along creases 508*b*, 518, 528, and 530 (to create closed bottom panel).

The right side panel includes panels P, Q, W, X, and Y. It is attached to the front panel along crease 508*b*; to the top right side flap along crease 506; to the bottom right side flap along crease 518; and to the end tab along crease 512*b*. It folds along creases 516, 532, and 534 (when collapsed); along crease 518 (to create closed bottom panel); along crease 512*b* (to attached right side panel to back panel via end tab); along crease 506 (when package closed); and along crease 508*b*.

The top right side flap includes panels I and J. It includes a tab at the top center of the flap that is bisected by crease 510*b*. It is attached to the right side panel along crease 506 and folds along crease 506 (when package is closed).

The bottom night side flap includes panels II and JJ. It is attached to tie bottom front flap along crease 508*b*; to the right side panel along crease 518; and to the end tab along crease 512*b*. It folds at crease line 518 (to create closed bottom panel); and at crease lines 512*b* and 508*b*. It is bisected by crease 510*b*.

The end tab includes panels K, R, Z, and KK. It is attached to the right side panel and the bottom right flap along crease 512*b*. It folds along crease 512*b* and contains adhesive that sticks to the inside back panel to form the closed package.

The gift package as described is a novel assemblage of components and materials which provides a complete structure and system for gift packaging which is compactly packaged and neatly presented for sale, easily and quickly assembled, filled and closed, and which has the finished appearance of a paper-wrapped box.

The invention claimed is:

1. A gift package for receiving and securely retaining gift contents, the gift packaging in a folded condition in combination with a retail display header which is engaged with the gift package in the folded condition;

the gift package comprising:

a generally cubic structure formed by interconnected panels including:

a front panel;

a back panel generally opposed to and spaced from the front panel;

first and second generally opposed side panels;

a bottom panel; and the front panel comprising one main panel that is connected to the bottom panel along a horizontal fold line and connected to the first and second generally opposed side panels along two parallel vertical fold lines;

the back panel comprising a main panel connected along a horizontal fold line to a sub-panel that is connected to the bottom panel along a horizontal fold line;

the first side panel comprising five first side sub panels, two of which are connected along a horizontal fold line to the bottom panel, two of which are connected to the back panel along a vertical fold line, and one which is connected to the front panel along a vertical fold line, and a vertical crease bisecting the first side panel;

the second side panel comprising five second side sub panels, two of which are connected along a horizontal fold line to the bottom panel, two of which are connected to an end tab along a vertical fold line, and one of which is connected to the front panel along a vertical fold line, and a vertical crease bisecting the second side panel;

the bottom panel comprising a bottom left side flap comprising two panels bisected by a vertical fold line and connected to the first side panel along a horizontal fold line, a bottom right side flap comprising two panels bisected by a vertical fold line and connected to the second side panel along a horizontal fold line, a bottom back flap comprising three panels that are connected to the back panel along a horizontal fold line, and a bottom front flap comprising three panels that are connected to the front panel along a horizontal fold line;

a front flap connected to the front panel along a horizontal fold line and upon which a small strip of adhesive is applied, a back flap that is connected to the back panel along a horizontal fold line, a first side flap comprising a slot at the top center of said flap and connected to the first side panel along a horizontal fold line, and a second side flap comprising a tab at the top center of said flap and connected to the second side panel along a horizontal fold line;

wherein the front panel, the back panel, the side panels, and the bottom panel together form a three-dimensional rectangular package with at least one opening therein, the at least one opening configured to allow passage of one or more objects into an interior of the gift package formed by the front, back, side and bottom panels; and wherein the opening to the gift package is closed by the first side flap folded relative to the first side panel and the second side flap folded relative to the second side panel, engaging a tab with a slot, a back flap folded relative to the back panel, and the front flap containing a small strip of adhesive folded relative to the front panel and attached adhesive to the back flap;

the retail display header comprising:

a substantially rectangular piece of paperboard;

wherein the paperboard contains a fold line that bisects the center of the protective retail display header;

wherein the paperboard contains two straps attached to the inside portion of the paperboard, one strap attached to each of the two panels and each located proximate to the center fold line and operative to secure the gift package in place;

wherein adhesive is applied to a surface of at least one strap;

wherein the paperboard contains two openings located proximate to the fold line that correspond and create one opening when the paperboard is folded along the center fold line, and is used to be inserted on a display hanger to display the gift package secured by the header;

wherein the gift package is inserted underneath each strap and folded with the header at the bisection fold line; and wherein the two straps, when the header is closed, are adhered in a folded and closed position to one another and not to the gift package secured by the display header.

2. The gift package of claim 1, wherein the second side flap further comprises two wings, one at the top left and one at the top right side of said flap and wherein the wings are adhesively secured to the underside of the first side flap.

3. The gift package of claim 1, wherein the panels are formed from a paper-like material having a weight of about 120 to about 250 grams per square meter.

4. The gift package of claim 1, wherein a decorative ribbon is secured around the midsection of the body of the gift package and tied into a decorative bow that is attached at the front panel of the gift package.

5. In combination, a gift package for receiving and securely retaining gift contents in combination with a protective retail display header which is folded about the gift package with the gift package in a folded configuration, the gift package and protective retail display header combination comprising:

a gift package of generally cubic structure formed by interconnected panels including:

a front panel;

a back panel generally opposed to the front panel;

first and second generally opposed side panels;

a bottom panel;

the front panel comprising one main panel that is connected to the bottom panel along a horizontal fold line and connected to the first and second generally opposed side panels along two parallel vertical fold lines;

the back panel comprising a main panel connected along a horizontal fold line to a sub-panel that is connected to the bottom panel along a horizontal fold line;

the first side panel comprising five first side sub panels, two of which are connected along a horizontal fold line to the bottom panel, two of which are connected to the back panel along a vertical fold line, and one which is connected to the front panel along a vertical fold line, and a vertical crease bisecting the first side panel;

the second side panel comprising five second side sub panels, two of which are connected along a horizontal fold line to the bottom panel, two of which are connected to an end tab along a vertical fold line, and one of which is connected to the front panel along a vertical fold line, and a vertical crease bisecting the second side panel;

the bottom panel comprising a bottom left side flap comprising two panels bisected by a vertical fold lien and connected to the first side panel along a horizontal fold line, a bottom right side flap comprising two panels bisected by a vertical fold line and connected to the second side panel along a horizontal fold line, a bottom back flap comprising three panels that are connected to the back panel along a horizontal fold line, and a bottom front flap comprising three panels that are connected to the front panel along a horizontal fold line;

a front flap connected to the front panel along a horizontal fold line, a back flap that is connected to the back flap along a horizontal fold line, and a left side flap connected to the second side panel along a horizontal fold line and comprising a downward folding lip across its top edge;

wherein the opening to the gift package is closed by the front flap folded relative to the front panel, the back flap folded relative to the back panel, and the left side flap, comprising a downward folding lip across its top edge, folded relative to the second side panel wherein the downward folding lip is inserted into the inside of the first side panel;

a retail display header comprising a substantially rectangular piece of paperboard;

wherein the paperboard contains a fold line that bisects the center of the protective retail display header;

wherein the paperboard contains two straps, one strap attached to each panel attached to the inside portion of paperboard each located proximate to the center fold line and configured to engage with the gift package;

wherein at least one of the straps has adhesive applied to a surface thereof;

wherein the paperboard contains two openings spaced approximately ½ inch from the fold line and which can be aligned to form an opening when the paperboard is folded along the center fold line to receive a display hanger for hanging display of the gift package and retail display header combination;

wherein the two straps are adhered to one another and not in contact with the gift package secured by the header; and wherein the gift package is inserted underneath each strap and folded with the header at the bisecting fold line.

6. The gift package of claim 5, wherein the panels are formed from a paper-like material having a weight of about 120 to about 250 grams per square meter.

7. The gift package of claim 5, wherein a decorative ribbon is secured around the midsection of the body of the gift package and tied into a decorative bow that is attached at the front panel of the gift package.

* * * * *